US010443014B2

(12) United States Patent
Kamata et al.

(10) Patent No.: US 10,443,014 B2
(45) Date of Patent: Oct. 15, 2019

(54) DEFOAMING AGENT COMPOSITION FOR LUBRICATING OIL AND METHOD OF DEFOAMING USING THIS

(75) Inventors: Kumiko Kamata, Kanagawa (JP); Hiroyuki Tazaki, Kanagawa (JP)

(73) Assignee: SHELL OIL COMPANY, Houston, TX (US)

( * ) Notice: Subject to any disclaimer, the term of this patent is extended or adjusted under 35 U.S.C. 154(b) by 912 days.

(21) Appl. No.: 14/002,234

(22) PCT Filed: Mar. 2, 2012

(86) PCT No.: PCT/EP2012/053655

§ 371 (c)(1),
(2), (4) Date: Oct. 21, 2013

(87) PCT Pub. No.: WO2012/117098

PCT Pub. Date: Sep. 7, 2012

(65) Prior Publication Data

US 2014/0038863 A1 Feb. 6, 2014

(30) Foreign Application Priority Data

Mar. 2, 2011 (JP) ..... 2011-045148

(51) Int. Cl.
*C10M 173/02* (2006.01)
*C07F 5/04* (2006.01)
*C10M 169/02* (2006.01)

(52) U.S. Cl.
CPC .. *C10M 169/02* (2013.01); *C10M 2201/0856* (2013.01); *C10M 2213/0606* (2013.01);
(Continued)

(58) Field of Classification Search
CPC .. C10M 105/52; C10M 113/08; C10M 115/06
(Continued)

(56) References Cited

U.S. PATENT DOCUMENTS

2003/0086203 A1 5/2003 Khan
2004/0121921 A1 6/2004 Calcut et al.
(Continued)

FOREIGN PATENT DOCUMENTS

CA 2651440 11/2007
CA 2704927 11/2011
(Continued)

OTHER PUBLICATIONS

Heat Resistant Grease Employing Tricalcium Phosphate as a Thickener, Petroleum Products Discussion Forum; Sekiyu Seihin Toron Kai; pp. 107-110, 2009—not in English language.

*Primary Examiner* — Prem C Singh
*Assistant Examiner* — Francis C Campanell

(57) ABSTRACT

The present invention provides a defoaming agent composition in gel form, of number 1 NLGI grade or harder, for application to the inside wall of a container, being a composition for defoaming bubbles generated from lubricating oil present within a container. The present invention further provides a method of defoaming lubricating oil characterized in that it includes a step of applying a defoaming agent composition in gel form, of number 1 NLGI grade or harder, to the inside wall of a container for lubricating oil and characterized in that this step is a step in which said defoaming agent composition is applied to the inside wall face at or above the oil surface of the lubricating oil, or higher than this.

10 Claims, 1 Drawing Sheet

(52) U.S. Cl.
CPC ... *C10M 2229/025* (2013.01); *C10N 2230/18* (2013.01); *C10N 2240/04* (2013.01); *C10N 2250/10* (2013.01)

(58) Field of Classification Search
USPC ..... 508/162
See application file for complete search history.

(56) References Cited

U.S. PATENT DOCUMENTS

| | | | | |
|---|---|---|---|---|
| 2007/0213240 | A1* | 9/2007 | Shimura | C10M 105/54 508/588 |
| 2009/0305920 | A1* | 12/2009 | Kato | C10M 169/06 508/162 |
| 2010/0275725 | A1* | 11/2010 | Tolksdorf | F16H 47/04 74/732.1 |

FOREIGN PATENT DOCUMENTS

| | | | |
|---|---|---|---|
| JP | 60000086 | | 1/1985 |
| JP | 2000087069 | A | 3/2000 |
| JP | 2004331933 | A | 11/2004 |
| JP | 2009292918 | A | 12/2009 |
| WO | 2008055998 | | 5/2008 |
| WO | 2009027428 | | 3/2009 |

* cited by examiner

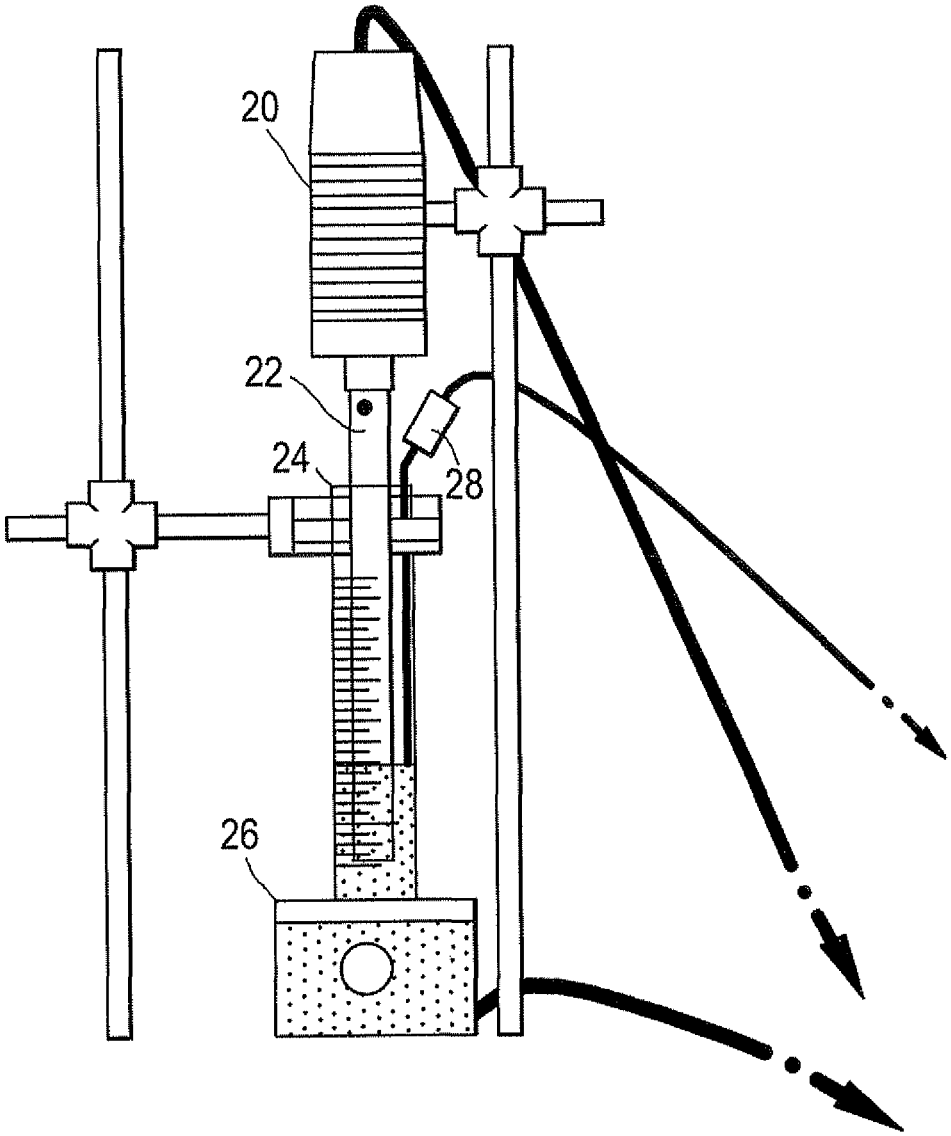
20
22
24
28
26

DEFOAMING AGENT COMPOSITION FOR LUBRICATING OIL AND METHOD OF DEFOAMING USING THIS

PRIORITY CLAIM

The present application which is a 371 application of PCT/EP2012/053655 and claims priority from PCT/EP2012/053655, filed 2 Mar. 2012, which claims priority from Japanese application no. 2011-045148, filed 2 Mar. 2011, which is incorporated herein by reference.

FIELD OF THE INVENTION

The present invention relates to defoaming technology of lubricating oil present in a container such as an oil tank.

BACKGROUND OF THE INVENTION

Lubricating oil can reduce friction between members and is used to assist the operation of many mechanical constituents. For example, the lubricating oil that is employed in an automobile gearbox (automobile gearbox oil), in addition to lubrication or cooling of gears, is employed in order to perform friction control or hydraulic operation during the engagement of a wet clutch. However, increase in bubbles in the lubricating oil causes problems such as impeding the cooling action, fluctuation of hydraulic pressure and acceleration of oxidative deterioration, and may eventually lead to failure of the hardware of the gearbox or the like. Lubricating oil therefore usually contains a defoaming agent. Also, in circumstances in which the viscosity of the lubricating oil is lowered with a view to saving fuel costs, the lowered viscosity results in increased foaming properties, so careful attention must be paid to anti-foaming measures.

In general as a defoaming agent for lubricating oil, rather than fluorine-based defoaming agents, to be described, ordinary silicone-based defoaming agents (such as polydimethylsiloxane) are employed: in particular, defoaming agents are frequently employed whose dynamic viscosity at 25° C. is in the range of from 50,000 to 1,500,000 $mm^2/s$. Outside this range, defoaming properties at high temperature become unsatisfactory. A preferable range is from 80,000 to 1,200,000 $mm^2/s$. A polydimethylsiloxane constituent may be employed on its own or as a combination of two or more types thereof. Regarding the blending amount, the polydimethylsiloxane constituent is preferably blended with the base oil in a ratio of from 1 to 50 weight ppm, based on the total weight of the composition. If the blending amount is less than 1 weight ppm, a defoaming effect may not be produced; if the blending amount exceeds 50 weight ppm, a beneficial effect matching the blending amount may not be achieved. More preferably, the blending amount is in the range of from 3 to 30 weight ppm.

Fluorine-based defoaming agents have therefore been proposed as defoaming agents having a high defoaming capability. For example, fluorine-modified silicones have applicability to low-viscosity lubricating oils of high solubility, since they are more insoluble with respect to the lubricating oil than the conventionally employed silicone-based defoaming agents. Furthermore, fluorine-modified silicones also have high defoaming capability at high temperature. However, fluorine-modified silicones have a large specific gravity, and so tend to separate out within the container prior to filling. Thus, even though fluorine-based defoaming agents exist that have a high latent capability as defoaming agents, since some of these are problematic in regard to storage stability, the present situation is that fluorine-based defoaming agents are not effectively utilised as defoaming agents for lubricating oil.

Japanese Patent Publication 60000086B proposes a different technique from the technique of mixing a fluorine-based defoaming agent with the lubricating oil. Specifically, Japanese Patent Publication 60000086B discloses a defoaming agent having excellent defoaming properties including a fluorine-containing compound in which a C3 to C20 fluorinated aliphatic group and a high aliphatic group of carbon number 10 or more are included in the same molecule. Also, as the method of use of this defoaming agent, apart from the technique of mixing with the lubricating oil, the technique of applying the defoaming agent to the rim of the container is proposed. The benefit of this latter technique is explained to be that any bubbles rising to the top are dissipated when they come into contact with the surface where the defoaming agent has been applied (page 5 block 6 to page 4 block 7).

Thus, although a defoaming effect can be obtained for a short period with the fluorine-based defoaming agent described in Japanese Patent Publication 60000086B with the technique described (technique of applying the defoaming agent to the rim of the container), there is the problem that a defoaming effect cannot be achieved in this way over a long period. Also, however high the defoaming effect, if fluid is employed, as has been the case up to the present, over a long period, this will flow downwards due to its weight, so it is thought that in general a prolonged effect will be better sustained by using a gel-form composition of high NLGI grade. Furthermore, if a defoaming agent in the form of a paste employing solid microparticles of silica as indicated in Japanese Patent Publication 60000086B is used, the silica constitutes a solid foreign body that causes abrasive wear, which has an adverse effect on lubrication performance.

A further problem was that, since the conventional defoaming agent was mixed with the lubricating oil beforehand, the amount of the defoaming constituent was diminished during use owing to capture by the filter. Furthermore, in an automatic gearbox (AT, CVT), the lubricating oil is circulated within the container by using a hydraulic pump and there is a possibility that foaming may occur during this process: such foaming results in poor lubrication, which may have consequences such as loss of the ability to control the device.

Accordingly, an object of the present invention is to provide technology for defoaming lubricating oil whereby a high defoaming capability can be maintained over a long period, employing a defoaming agent of a gel-form composition constituting a solid lubricant.

SUMMARY OF THE INVENTION

The present invention relates to a defoaming agent composition of gel form which is of number 1 NLGI grade (in accordance with the NLGI grade classification specified by the NLGI [National Lubricating Grease Institute, USA]) or harder, and relates to a method of defoaming lubricating oil characterised in that it includes a step of applying this defoaming agent composition to the inside wall of a container for lubricating oil.

According to the present invention, by applying a defoaming agent composition which is of gel form of number 1 NLGI grade or harder to the inside wall of a lubricating oil container, the defoaming constituent is gradually released, as a result of which the beneficial effect, possessed by the defoaming agent composition, of showing a high defoaming capability over a long period, can be manifested. Furthermore, according to the present invention, the bubbles that are produced when foaming of the lubricating oil occurs come into contact with the defoaming composition and the defoaming constituent is supplied into the lubricating oil every time such contact occurs: as a result the beneficial effect is obtained that even foaming agent compositions which are in themselves unsuitable for mixing with lubricating oil (such as for example fluorine-based defoaming agents that are of high specific gravity and so easily separate out) become usable. Furthermore, according to the present invention, a defoaming effect is manifested that is not restricted to specific types of lubricating oil (for example, the defoaming effect is manifested even in the case of lubricating oils of high solubility and low viscosity). Furthermore, according to the present invention, a large holding force is achieved, so that softening and dripping off at high temperature is prevented: as a result, the beneficial effect is obtained that a stable defoaming capability can be maintained for a long period even in a high-temperature environment. Furthermore, loss of defoaming agent due to capture by the filter can be made up by the gradual release of the defoaming constituent from the container inside wall. Also, problems such as poor lubrication or loss of ability to control the device can be overcome by the release of defoaming agent from the inside walls when foaming occurs, even in an automatic gearbox.

BRIEF DESCRIPTION OF THE DRAWINGS

FIG. 1 is a diagram of equipment employed in a practical example of the present invention and in a comparative example.

DETAILED DESCRIPTION OF THE INVENTION

While the present invention is described in detail below, the invention is not restricted in any way to such specific applications, and can of course be applied to a wide range of applications that may be selected at will. It should be noted that although, hereinbelow, a fluorine-based defoaming composition is taken as an example of a defoaming composition since it has excellent defoaming performance, there is no restriction to this and the present invention could be applied to other defoaming agent compositions (such as for example silicone-based defoaming agent compositions).

The present practical example relates to a defoaming agent composition of gel form which is of number 1 NLGI grade or harder, for applying to the inside wall of a container for lubricating oil. It further relates to a method of defoaming lubricating oil characterised in that this defoaming agent composition is employed. Such a defoaming agent composition necessarily includes a "defoaming constituent" and "base oil", and may include a "thickener". However, these terms merely refer to the functionality and do not necessarily imply chemically different constituents. Specifically, if for example a given constituent functions as both a defoaming constituent and a base oil, such a constituent constitutes both a "defoaming constituent" and a "base oil". First of all, we shall describe a defoaming agent composition (constituents and properties) that is used as an active constituent and will then describe the method of its use.

Fluorine-Based Defoaming Agent Composition Constituents

Although the defoaming agent composition according to the present invention is not restricted to fluorine-based defoaming agent compositions, a fluorine-based defoaming agent composition will now be described. A fluorine-based defoaming agent composition contains a constituent (defoaming constituent) that contains a fluorine atom. Examples of defoaming constituents that may be used include: partially or completely fluorinated alkanes (for example perfluoroalkanes); partially or completely fluorinated alkyl ethers (for example perfluoroalkyl ethers); fluorine-modified silicones (fluorosilicone oils); or perfluoroalkyl-containing oligomers and perfluoroalkyl ethylene oxide adducts. A fluorine-based grease is described below as a preferred fluorine-based defoaming agent composition.

Fluorine-Based Grease

The "fluorine-based grease" of the preferred example is a gel-form composition comprising a base oil and thickener (which may contain additives), and indicates a lubricating oil employing a compound containing fluorine in at least part of the base oil, thickener and/or additives. As the fluorine-based grease, grease whose base oil is a fluorine oil is preferable: there may be mentioned by way of example a mode in which the base oil is the defoaming constituent (i.e. a fluorine oil (fluorine-based organic solvent) of the defoaming constituents referred to above, such as for example a perfluoropolyether (PFPE oil), perfluoroalkyl ether (PFAE oil), a low polymer of chlorotrifluoroethylene (CTFE oil), or fluorine-modified silicone), or a mode in which the thickener is the defoaming constituent (for example polytetrafluoroethylene (PTFE)). This grease is obtained by suitably adjusting the NLGI grade by addition of a freely selectable amount of thickener (such as for example tricalcium phosphate) or additive to a fluorine-based base oil (fluorine oil), or by adjusting the NLGI grade by addition of a fluorine-based thickener or additive to a freely selectable base oil. Also, there may be mentioned by way of example the CaP fluorine oil grease disclosed in Collected Papers submitted to the Petroleum Products Discussion Forum (Sekiyu Seihin Toron Kai) 2009 P107-110 "Heat resistant grease employing tricalcium phosphate as a thickener". Of such greases, the CaP fluorine oil grease described above, specifically, a grease in which fluorine oil is selected as the base oil and tricalcium phosphate is selected as the thickener, is particularly suitable.

Properties of Defoaming Agent Composition

Grease of number 1 NLGI grade or harder (up to grade number 4, though no particular upper limit is specified) that is employed in the gel-form defoaming agent composition according to the present embodiment is suitable: more preferably the grease may be of number 2 or number 3 grade. If the NLGI grade is softer than number 0, it may be surmised that the grease might flow downwards over a long period of use, which would be undesirable. The method of determination of the NLGI grade is as set out in JIS K2220.

There is no particular restriction regarding the form of the gel-form composition, and this may be for example a grease, cream or ointment. For example, if the gel-form composition is a grease, the dynamic viscosity of the base oil may be in the range of from 5 to 60 $mm^2/s$ at 100° C., preferably in the range of from 10 to 50 $mm^2/s$. The dynamic viscosity at 100° C. may be determined in accordance with JIS K2283. It may be surmised that if the dynamic viscosity becomes too low, oil separation may tend to occur, lowering the retention of the defoaming constituent, or facilitating detachment of the defoaming agent composition, with consequent diminution or loss of the defoaming effect. On the other hand, if the dynamic viscosity is too high, it may be surmised that the defoaming constituent may not be properly dispersed in the oil, with the result that it cannot function as a defoaming agent.

Method of Use

The method of use according to the present embodiment includes a step of applying the gel-form defoaming agent composition described above to the inside wall of the container for lubricating oil. Specifically, this differs from the conventional technique of adding the defoaming agent to the lubricating oil. However, this may be combined with the conventional technique of adding the defoaming agent to the lubricant (in this case, if the amount of foaming is increased due to insufficiency of the defoaming agent as a result of capture by the filter or the like, such foaming is suppressed by deployment of the defoaming constituent into the oil from the defoaming agent composition that was applied in gel form). Hereinbelow, first of all, a case of application of the above method will be described; next, the aforementioned step in this method will be described.

Case of Application to a Container

There is no particular restriction as to the containers that may be employed in the present embodiment and for example gearboxes for automobiles or motorbikes (such as for example a manual gearbox, automatic gearbox, or EV reduction gear) may be mentioned by way of example; in particular, this embodiment may be suitably applied to gearboxes for AT use or CVT use. In gearboxes for AT use or CVT use, foaming occurs when lubricating oil is circulated within the container using the hydraulic pump, but, by applying the present embodiment, problems such as poor lubrication and loss of controllability of the device as a result can be prevented.

Case of Application to Lubricating Oil

There is no particular restriction regarding the lubricating oil to which the present embodiment may be applied. For example, as the base oil for the lubricating oil, there may be mentioned mineral oils called highly refined base oil, synthetic oils or mixtures of these (for example, base oils belonging to Group 1, Group 2, Group 3, Group 4 or Group 5 in the base oil category of the API (American Petroleum Institute), either alone or in the form of a mixture thereof). Also, there is no particular restriction to the content of base oil in the lubricating oil and this may be for example at least 60 weight % based on the total amount of the lubricating oil composition, preferably at least 70 weight %, more preferably at least 80 weight % and even more preferably at least 90 weight %.

Application Step

The application step according to the present embodiment is implemented by application of the defoaming agent composition to the inside wall of the lubricating oil container (i.e. the side portion thereof or a component such as for example a breather tube or oil gauge that is installed at a position higher than the oil surface of the container). Suitably, the defoaming agent composition is applied at or above the surface of the lubricating oil, or a position higher than this. The assumption in this case is that a defoaming action is unnecessary unless foaming of the lubricating oil occurs. In other words, foaming of the lubricating oil elevates the oil surface, enabling the foam to reach the location of application of the defoaming agent composition and contact of the foam and the defoaming agent composition thus constitutes the mechanism of the action whereby the defoaming constituent is mixed with the lubricating oil. By this arrangement, it becomes possible to prevent the defoaming constituent from being washed off from the inside wall side section of the container in a short time due to continued contact between the lubricating oil and the defoaming constituent. It should be noted that there is no particular restriction as regards the technique whereby application is effective and this could be achieved for example by coating or spraying.

EXAMPLES

While the present invention is described below with reference to examples and comparative examples, the present invention is not restricted to the following.

Example 1

About 0.03 g of grease (CaP fluorine oil grease: white colour, NLGI grade number 2, base oil dynamic viscosity (100° C.): 40 $mm^2/s$) containing perfluoropolyether as a fluorine-based defoaming agent composition was applied to the inside face of the test container by the procedure set out below. The base oil of the grease used in this case is perfluoroether and the thickener is tricalcium phosphate.

Comparative Example 1

About 0.03 g of defoaming agent composition constituted by high vacuum silicone grease from Dow Corning Inc. was applied to the inside face of the test container by the procedure set out below. The NLGI grade of this composition was number 0.

Comparative Example 2

About 0.03 g of defoaming agent composition constituted by SH 200-100,000 cSt from Toray/Dow Corning Silicone Inc. was applied to the inside face of the test container by the procedure set out below (example of use of extremely high-viscosity silicone oil). The 25° C. dynamic viscosity of this composition was 100,000 $mm^2/s$.

Defoaming Test

A foaming test was conducted using the equipment of the diagram shown in FIG. 1. An evaluation was conducted by the following method, to evaluate the amount of foaming, using a homogeniser (20).

Equipment Used

Homogeniser (20): IKA Labortechnik Ultra-Turaax T25

Generator shaft (22): S-25N-25F (manufactured by the same company as the homogeniser referred to above)

Cylinders (24): made of glass, height 20 to 160 mm (1 mm each), graduated, internal diameter 36 mm, thickness 2 mm, height 200 mm Heater (26): heater having sufficient electrical capacity to heat the oil to a temperature of 140° C. when oil was introduced into the aforementioned cylinders (24)

Thermocouple (28): capable of measurement from 80° C. to 140° C. at 10° C. intervals Reference Oil As reference oil (lubricating oil), the oil: Shell ATF manufactured by Showa Shell Sekiyu Ltd, excluding the defoaming agent, was employed.

Preparation for Measurement 1. 62.5 mL volume of the samples prepared in Example 1, Comparative Example 1 or Comparative Example 2 was taken (55 mm on the graduated scale).
2. The equipment was set up as shown in the diagram.
3. The positions of the homogenisers (20) were matched. Specifically, the positions of the holes on the shafts were matched with the 50 to 60 mm positions of the cylinders (24)

(oil surface 65 to 66 mm at room temperature). At this point, the distance of the tip of the shaft from the bottom of the container was in the vicinity of 20 mm.

4. The homogenisers (20) were rotated at 8000 rpm, and the oil was heated by the heaters up to the measurement temperature.

Method of Applying the Defoaming Agent Composition

The test device was set in position on the stirring shaft (outer) and the defoaming agent composition was then applied with an injector at a position of 90 to 95 mm (the volume when foaming of the reference oil occurred was 117 mm, so the aforementioned position was set so as to make it possible to ascertain the defoaming capability).

Measurement Sequence

1. The position of the oil surface (prior to stirring) at the measurement temperature (120° C.) was recorded, in a condition with the homogeniser (20) stopped.

2. The homogeniser (20) was rotated at 8000 rpm, and the heater output was readjusted to the measurement temperature.

3. When the measurement temperature had been reached, rotation of the homogeniser (20) at 20,000 rpm was commenced.

4. After stirring for 1 min, keeping the homogeniser (20) rotating, the position of the oil surface and the height of the surface of the foam were recorded (oil surface position after 1 min of stirring). The amount of foaming (mm) was obtained by calculation from "reading of the surface of the foam after stirring)−(reading of the oil surface prior to stirring)".

Test Results

The test results are shown in Table 1.

TABLE 1

| | | | Example 1 | Comparative Example 1 | Comparative Example 2 |
|---|---|---|---|---|---|
| Position of oil surface prior to stirring | | | 71 mm | 69 mm | 70 mm |
| Application | 1 min after stirring | Position of oil surface | 91 mm | 127 mm | 118 mm |
| | | Amount of foaming | 20 mm | 58 mm | 48 mm |
| No stirring | 1 min after stirring | Position of oil surface | 118 mm | 115 mm | 118 mm |
| | | Amount of foaming | 47 mm | 46 mm | 48 mm |
| Degree of increase/decrease of foam | | | −57% | +26% | ±0% |

In Example 1, on observing the inner circumference of the cylinder used for the foaming test, the phenomenon was ascertained that, when the foam that had been generated came into contact with the defoaming agent composition, defoaming occurred and further foaming did not take place. Furthermore, it was ascertained that the defoaming effect persisted even after the lapse of 1 min from the start of the test. It was surmised that the reason for continued manifestation of the excellent defoaming effect over a long period in this way was that, when the defoaming agent composition came into contact with the bubbles, these bubbles underwent partial collapse without experiencing excessive repulsion of the oil, and the perfluoropolyether, which possesses the defoaming effect, continued to be deployed in the oil to a suitable degree.

In contrast, in Comparative Example 1, even though the bubbles that were generated came into contact with the defoaming agent composition, foaming still occurred without manifestation of a defoaming effect. After 1 min from the commencement of the test, the amount of foaming had in fact increased, compared with the situation in which no defoaming agent composition was applied; in other words, an effect that could be described as a foaming effect was identified: thus it was found that there was an effect that was the opposite of the effect intended in the present invention.

Furthermore, in Comparative Example 2, the result was that the extent of increase/decrease of the foam was the same, irrespective of whether or not the defoaming agent composition had been applied: thus it was found that the defoaming agent composition manifested no defoaming effect.

It was therefore found that the defoaming agent composition used in the present invention, by application to the inside wall above the oil surface, had a highly beneficial effect in suppressing the foaming that was originally generated, compared with the defoaming agent composition employed in Comparative Example 1 and Comparative Example 2.

What is claimed is:

1. A method comprising:

applying a defoaming agent composition in gel form, of number 1 NLGI grade or harder, to the inside wall face of a container for a lubricating oil; and wherein the defoaming agent composition is applied to the inside wall face of the container at or above an oil surface of the lubricating oil;

wherein foam produced during foaming of the lubricating oil elevates the oil surface of the lubricating oil;

wherein the foam contacts the defoaming agent composition applied to the inside of the wall face of the container so as to mix the lubricating oil with the defoaming agent composition; and wherein the defoaming agent composition defoams the lubricating oil.

2. The method of claim 1 wherein the container is a gearbox.

3. The method of claim 1 wherein the defoaming agent composition is a fluorine-based defoaming agent composition.

4. The method of claim 1 wherein the defoaming agent composition is a fluorine-based grease comprising a base oil and a thickener.

5. The method of claim 4 wherein the base oil is a fluorine oil.

6. The method of claim 5 wherein the fluorine oil is selected from the group consisting of: a perfluoropolyether oil, a perfluoroalkyl ether oil, a low polymer of chlorotrifluoroethylene oil, a fluorine-modified silicone, and a combination thereof.

7. The method of claim 4 wherein the thickener comprises tricalcium phosphate.

8. The method of claim 1 wherein the defoaming agent composition has a number 1 NLGI grade.

9. The method of claim 1 wherein the defoaming agent composition has a number 2 NLGI grade.

10. The method of claim 1 wherein the defoaming agent composition has a number 3 NLGI grade.

* * * * *